US010478946B2

(12) United States Patent
Chiavenato

(10) Patent No.: US 10,478,946 B2
(45) Date of Patent: Nov. 19, 2019

(54) OPEN MESH ABRASIVE MATERIAL

(71) Applicant: KeyOn S.r.l., Verona (IT)

(72) Inventor: Alberto Chiavenato, Cerea (IT)

(73) Assignee: KEYON S.R.L., Verona (IT)

( * ) Notice: Subject to any disclaimer, the term of this patent is extended or adjusted under 35 U.S.C. 154(b) by 0 days.

(21) Appl. No.: 15/036,992

(22) PCT Filed: Nov. 18, 2014

(86) PCT No.: PCT/IB2014/002528
§ 371 (c)(1),
(2) Date: May 16, 2016

(87) PCT Pub. No.: WO2015/071752
PCT Pub. Date: May 21, 2015

(65) Prior Publication Data

US 2016/0256983 A1 Sep. 8, 2016

(30) Foreign Application Priority Data

Nov. 18, 2013 (IT) ..... MI2013A001908

(51) Int. Cl.
*B24D 18/00* (2006.01)
*B24D 11/00* (2006.01)

(52) U.S. Cl.
CPC ..... *B24D 18/0072* (2013.01); *B24D 11/001* (2013.01); *B24D 18/0027* (2013.01)

(58) Field of Classification Search
CPC . B24D 18/0072; B24D 18/0027; B24D 11/01
See application file for complete search history.

(56) References Cited

U.S. PATENT DOCUMENTS

| | | | | |
|---|---|---|---|---|
| 2,984,052 A | | 5/1961 | Mueller, Jr. | |
| 3,699,672 A | * | 10/1972 | Sims | A43B 3/00 15/227 |
| 6,077,601 A | * | 6/2000 | DeVoe | B24D 3/28 428/323 |
| 6,197,076 B1 | * | 3/2001 | Braunschweig | B24D 3/002 451/538 |
| 2002/0016139 A1 | * | 2/2002 | Hirokawa | B24B 37/24 451/54 |
| 2006/0148390 A1 | | 7/2006 | Woo et al. | |
| 2011/0159794 A1 | * | 6/2011 | Chung-Fat | B24B 55/06 451/527 |

FOREIGN PATENT DOCUMENTS

| | | |
|---|---|---|
| WO | 9607509 A1 | 3/1996 |
| WO | 9742005 A1 | 3/1997 |
| WO | 2006097141 A1 | 9/2006 |

OTHER PUBLICATIONS

International Search Report for PCT/IB2014/002528, 5 pages.

* cited by examiner

*Primary Examiner* — Pegah Parvini
(74) *Attorney, Agent, or Firm* — Ference & Associates LLC

(57) ABSTRACT

The present invention relates to an abrasive material in the form of a mesh, which is obtained by means of a method of impregnating an open mesh support with a binder, followed by the application of a suitable abrading material and subsequent drying or consolidation. The present material, due to the open mesh structure, allows the suction of the dust and residual material that is formed during the use thereof, and has optimum values of elasticity, resistance and efficacy.

13 Claims, 5 Drawing Sheets

OPEN MESH ABRASIVE MATERIAL

The present invention generally relates to a mesh-shaped abrasive material, which is obtained by means of a method of impregnating an open mesh support with a binder, followed by the application of a suitable abrading material and subsequent drying.

BACKGROUND OF THE ART

Conventional abrasives (or abrasive materials) usually have a support layer to which a suitable abrading material is fixed, by means of resins or glues, which is typically in the form of abrasive granules. These granules can be further consolidated by a second layer of resin or binder, thereby providing a material such as illustrated by way of example in FIG. 3. This type of material is particularly characterised by the continuity of the base support, which can be for example paper, cloth, plastic film, etc, permeable to air and specifically to suction system. While these products ensure high superficial planarity (depending on the typology of support being used) and high finishing, they do not allow the effective removal of the dusts and process residues without using sophisticated and expensive chemicals which are applied by means of additive layers to the abrasive base, and/or by means of suction holes. For example, when the abrasive material is used in the form of a disc, the provision of several holes is used to allow the suction of the dusts and process residues, thereby facilitating the use thereof and increasing the life thereof.

Abrasives on non-continuous support also exist, which are commercially designated as "non woven", such as illustrated in FIG. 5. These products provide for the abrasion of a non-continuous structure, by means of an abrasive agglomerate comprising binder in which the abrasive material particles are dispersed, which is generally applied by means of impregnation or spraying. The use of the agglomerate formed by binder pre-mixed with abrading particles usually results in final products having a lower speed of removal and processing than conventional abrasive products, which is mainly due to the compliance of the non-woven products and the rigidity of the individual agglomerate-coated filaments.

U.S. Pat. No. 6,024,634 describes a material obtained by contacting a teaseled support to an agglomerate formed by binder and abrading particles, which is directly applied to the support to be abraded. At this stage, in FIG. 1 is depicted a microscope image of a fibre (typically a net) which has been abraded in this manner.

Products characterized by the abrasion of a closed mesh woven fabric, supported by a sponge structure of various densities, such as illustrated in FIG. 4. On the one hand, these products provide an optimum finish, while on the other hand they are prone to the accumulation of dusts (clogging) while they are being used.

Accordingly, the problem exists of finding an abrasive material that provides optimum finishing properties and can be used without the substantial clogging problems that are due to the accumulation of dusts or residual material during use.

The applicants have now found out that a material having the desired characteristics can be prepared by means of impregnation of an open elastic mesh support with a binder, following the application of abrasive granules, as described in detail herein. With respect to the prior art, the present material is characterized by a convenient homogeneity and continuity of the impregnated fibre, such as illustrated for example in FIG. 2 herein, which further provides high flexibility, elasticity, finish consistency over time, and mainly a very low tendency to clogging.

SUMMARY OF THE INVENTION

In a first aspect thereof, this invention relates to a method for preparing an abrasive material, preferably an open mesh woven fabric, comprising:

a. impregnation with a binder of at least one side of a support, preferably of an open mesh woven fabric having a continuous structure, b. application of abrasive granules on said at least one impregnated side, c. drying of the material obtained, preferably by means of thermosetting thermal material, preferably hot or cold, as will be detailed below.

In a further aspect, the invention relates to an abrasive material, preferably an open mesh woven fabric which is obtained (or can be obtained) by the above process. In an embodiment, said material can be joined to a support material, preferably permeable to dust, thereby forming a coupled abrasive material.

In an additional aspect, the present invention relates to the use of the abrasive material herein, optionally coupled to a support preferably permeable to dust, for the polishing of surfaces.

DETAILED DESCRIPTION

Figure 1:
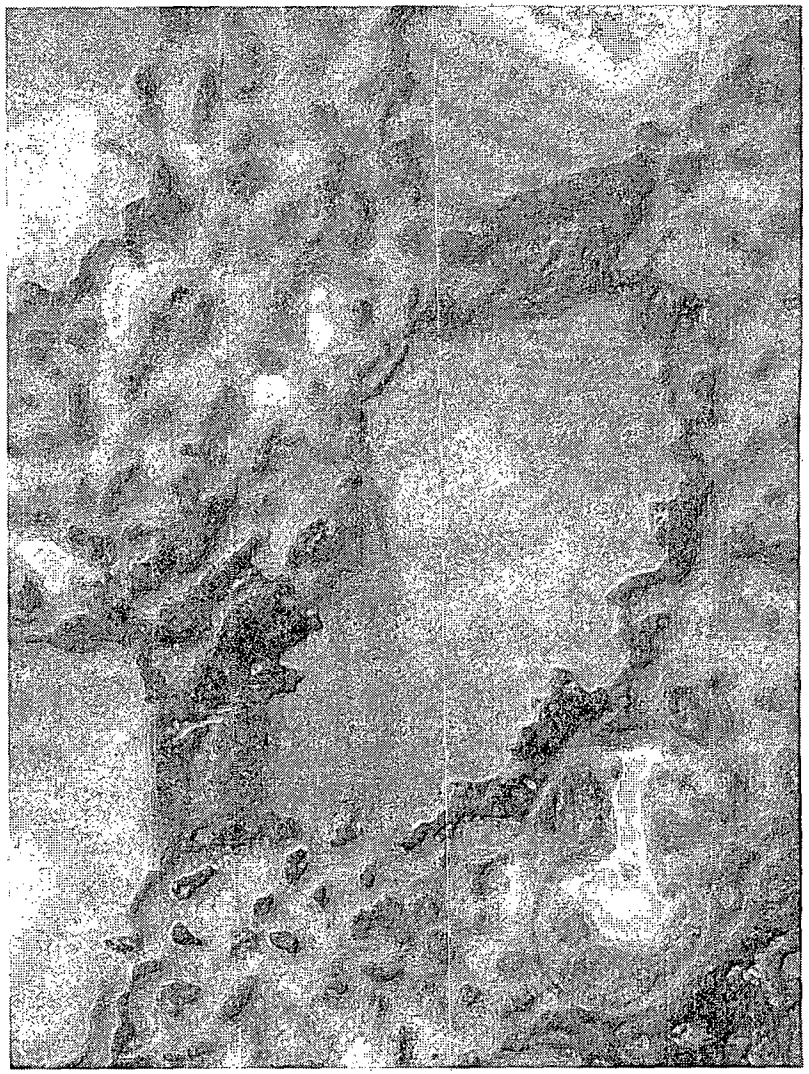
FIG. 1: microscope image (800× magnification) of a prior art abrasive product, for example obtained as indicated in U.S. Pat. No. 6,024,634.

With "abraded surface" is meant to designate a surface on which a suitable abrading material is provided, such as in the form of abrasive granules, which can be used in polishing processes on rough metal, plastic, wood surfaces, or the like, or surfaces treated for example with primers, paints, clearcoats or the like.

With "teaseled surface" is meant to designate a surface or a side of a mesh woven fabric which has been subjected to a teaselling operation, as known to those skilled in the art.

With "mesh" is meant to designate a woven fabric formed by an individual curvilinear continuous interweaving made using one or more threads, which interweave binding by means of crossings, either horizontally or vertically.

With "open mesh" is meant a mesh having holes or openings of a size equal to 0.2 and 10 times the thread diameter.

With "binder" is meant to designate a resin, glue, or, generally, a substance of natural or synthetic origin which has the purpose of causing the abrasive granules to permanently adhere to the mesh, according to the present invention.

By means of the present process, an abrasive material can be obtained having the following characteristics:

- high capacity of suction of the process residual dusts, and very low tendency to clogging, due to the open mesh structure,
- high surface finish, due to the possibility of setting and positioning of the abrasive granules in a homogeneous manner,
- very low operating temperature,
- possibility of being coupled to other supports, either permeable to the dust or not,
- high flexibility and mechanical resistance due to the particular impregnation of the binder of the superficial horizontal type and to the continuous structure of the mesh, which forms the abrasive material.

In greater detail, the present process allows obtaining an abrasive material that can be used in surface polishing operations, which comprises the steps of:

a. impregnation of an open, preferably woven, mesh support with a thermoplastic binder;
b. application of the abrasive granules; and
c. drying or consolidation of the binder by means of cold or hot thermosetting treatment as detailed below.

The open mesh is preferably an elastic woven fabric, can consist of natural or synthetic fibres and can have individual or interwoven threads. Several examples of fibres that can be used are: nylon, cotton, polyester or a combination thereof. In the inventive process, the elastic woven mesh is flexible and has a longitudinal and transversal elongation ranging between 1% and 100%, thereby allowing the abrasive granules to be vertically and tangentially set. To this purpose, the vertical setting is carried out in the direction of the working force (orthogonal to the working surface) and causes the elastic mesh to "absorb" the grain asperity.

The tangential compressibility, on the other hand, causes the elastic mesh to allow a slight rotation of the grain, such that the cutting angle on the work surface is reduced as much as possible. The setting of the elastic mesh prepared according to the criteria of the invention allows, unlike a traditional abrasive in which the grains are fixed, not compressible or settable, a greater and even finish with the grain size being equal.

In a preferred embodiment, the open mesh that can be used in the process for the preparation of the present abrasive woven material, has one teaseled side and one non-teaseled side. Still more preferably, the step a. of impregnation is selectively carried on the non-teaseled side. Thereby, the provision of the teaseled, preferably non-impregnated, side allows the anchoring to support systems such as Velcro type, or the like, which are particularly useful in case of industrial applications. The teaseled side, indeed, has embedded fastening loops (Velcro® type), which are typically obtained through teaselling. By way of non-limiting example, the disc-cut finished product, can be fixed onto a Velcro® pad (Hook and Loop) from the teaseled side.

As stated above, the mesh used in the present process has an open structure, i.e. it has a certain distance between the threads composing the structure, such that channels and/or holes are formed which allow sucking the dust while the material is being used as the abrasive agent. The distance between the threads can be proportional to the grain size of the abrasive which will be then applied and, in any case, it allows the process residual dusts to pass therethrough. This distance is preferably comprised between 0.2 and 10 times the thread diameter.

For example, if a mesh consisting of continuous interwoven threads is considered, the open surface contoured by the individual threads has a width of 0.5-10 times the diameter of a contour thread. The support mesh can further have a weight ranging from 20 g/m$^2$ to 400 g/m$^2$.

Figure 2:
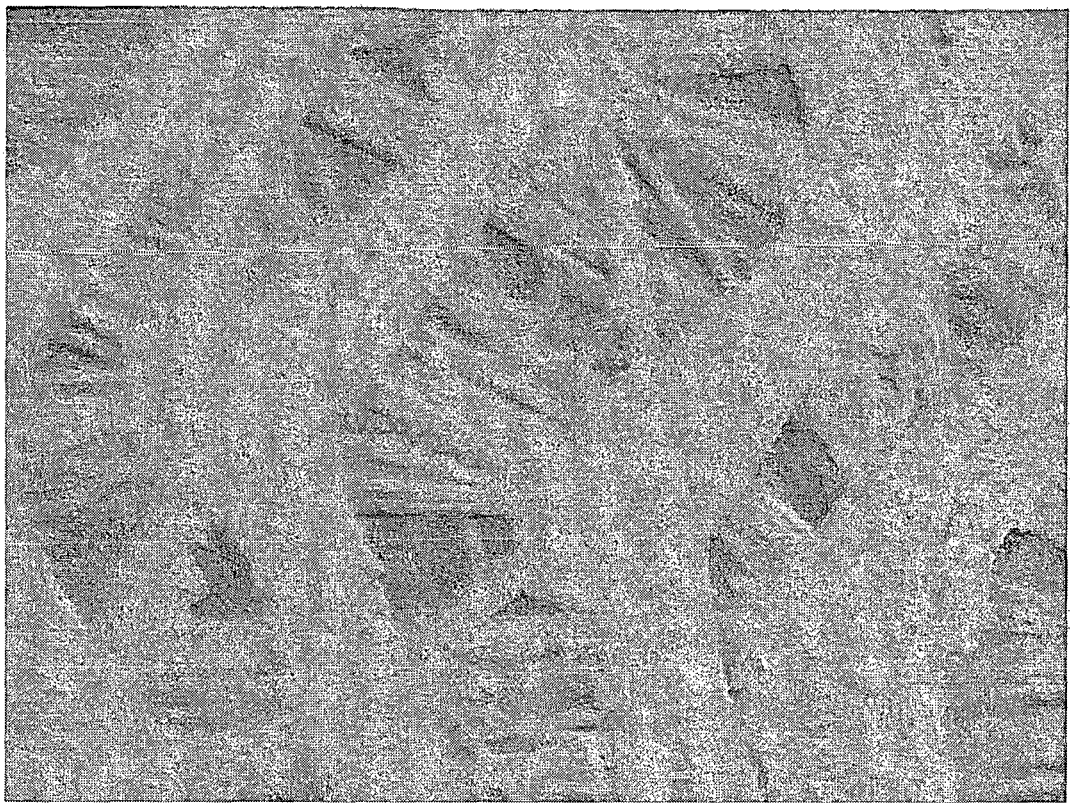
FIG. 2: microscope image (800× magnification) of an embodiment of the invention obtained according to Example 1, by impregnating a nylon woven nylon mesh fabric, with a polyurethane binder at a temperature ranging between 90° C. and 140° C., followed by the application of aluminium oxide granules and drying at a temperature ranging between 30° C. and 50° C.
Figure 3:
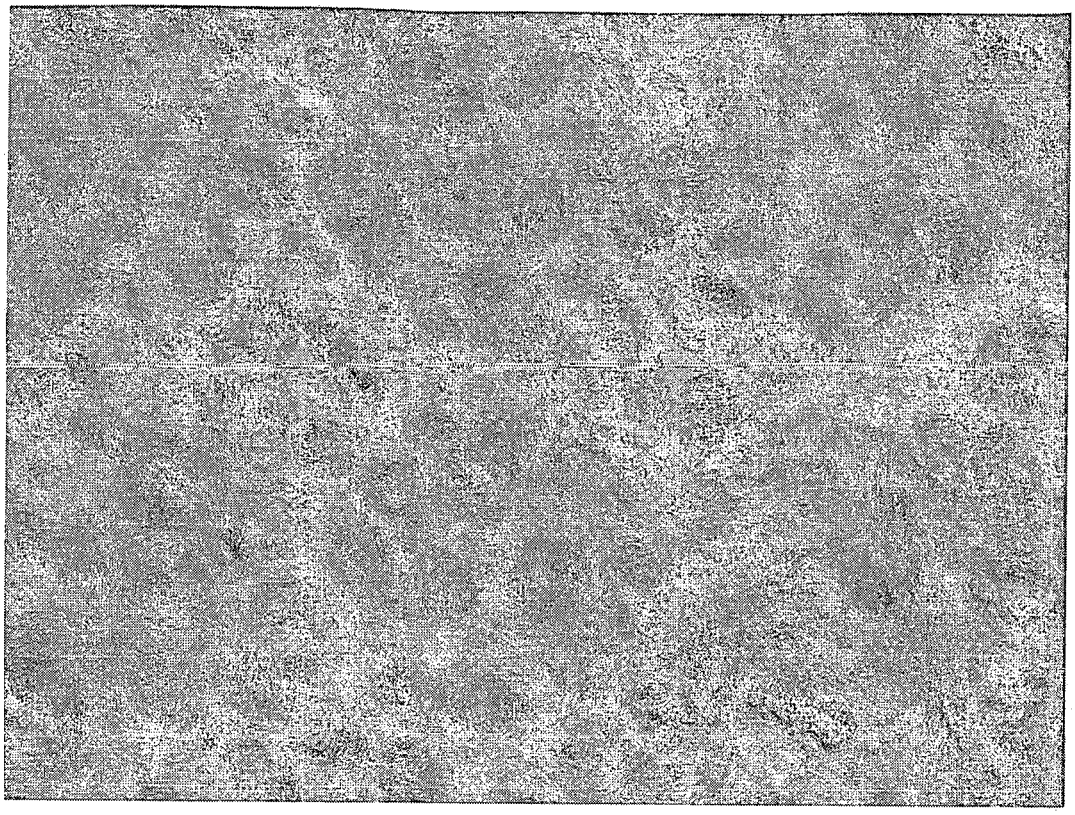
FIG. 3: microscope image (800× magnification) of a prior art abrasive product, such as abrasive paper on a continuous support.
Figure 4:
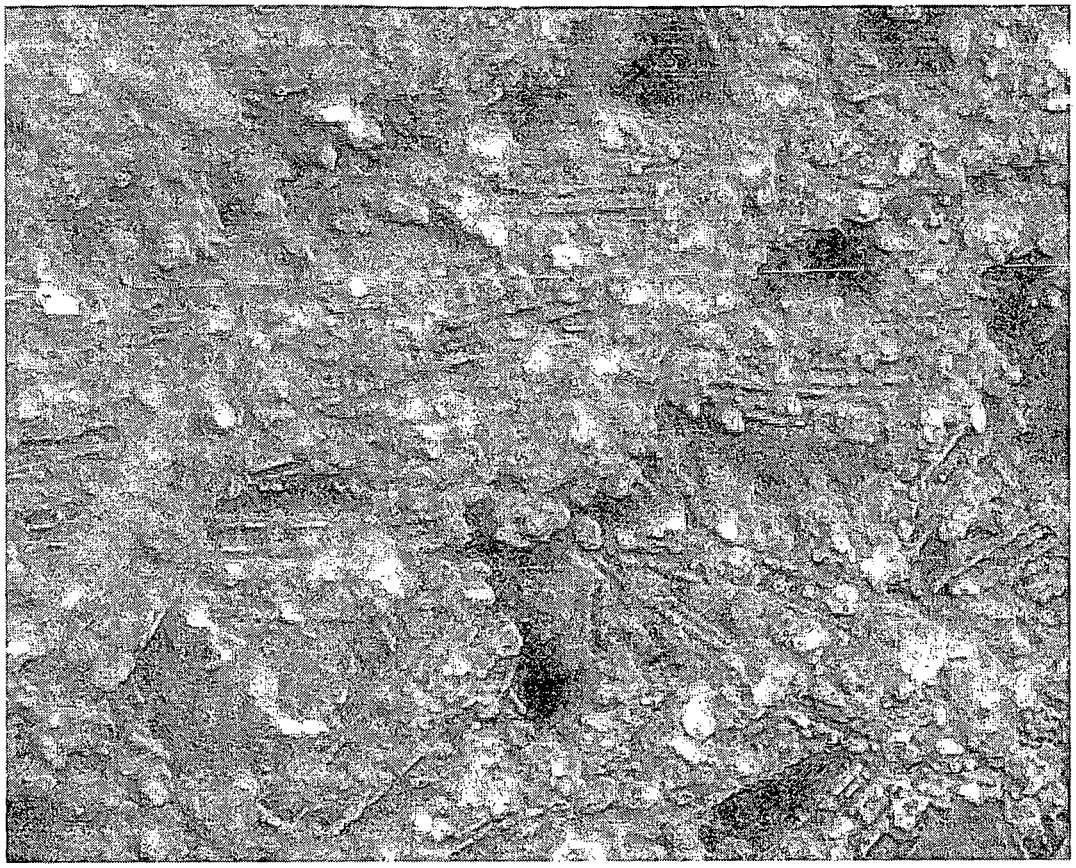
FIG. 4: microscope image (800× magnification) of a prior art abrasive product, obtained for example as stated in U.S. Pat. No. 6,024,634.
Figure 5:
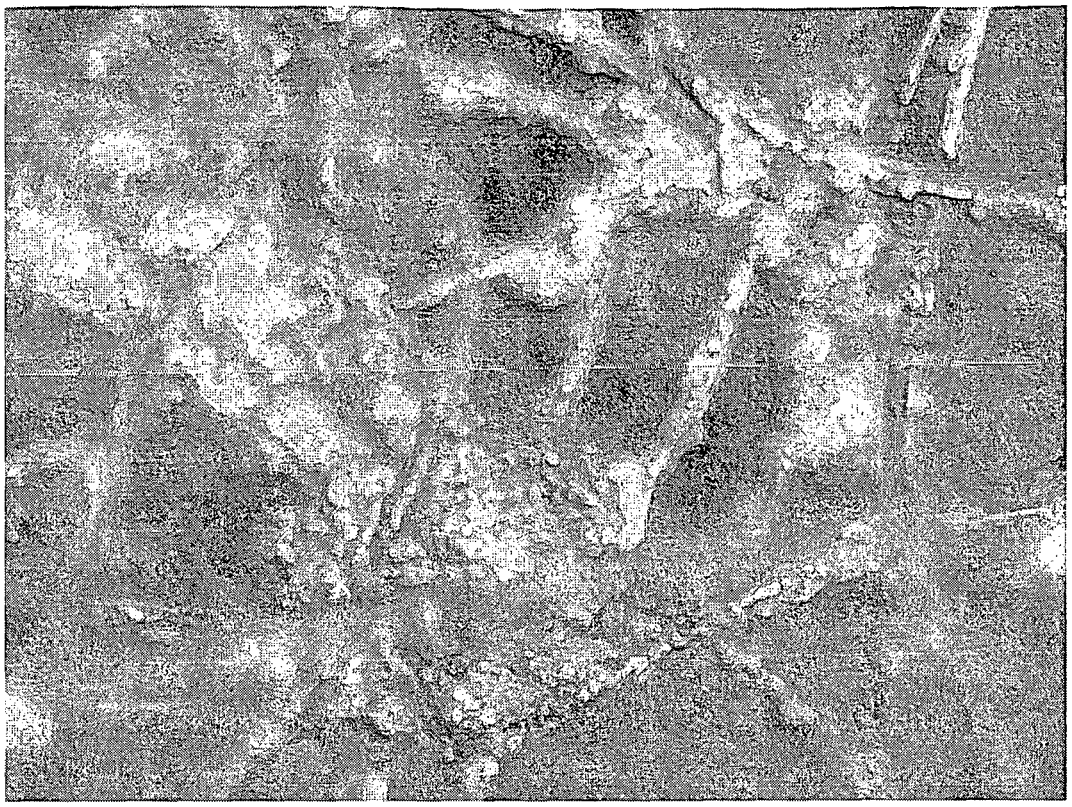
FIG. 5: microscope image (800× magnification) of a prior art product of a non-woven discontinuous type.

In order to maintain the desired characteristics, the impregnation of the mesh threads according to the present step a. is carried out continuously on the threads, without covering or blocking the holes or the gaps left by the threads between each other, as described above. FIG. 2 illustrates a microscope magnified image of an embodiment of the invention in which the presence of open holes and the structure of the abraded threads is evident, which characterize the material obtained with the present process.

Therefore, the impregnation according to step a. is preferably of the selective horizontal type, i.e. intended as being substantially parallel to the surface of the mesh to be impregnated and limited to the surface of the mesh. It results that the final material can have an abraded surface and a teaseled non-abraded one, substantially depending on the level of impregnation achieved during step a.

In practice, the surface impregnation of one or both sides of the mesh can be carried out using a binder extruder or by applying the binder with one or multiple rolls. By adjusting the production operating parameters (such as material feeding speed, amount of extruded or applied glue, temperature and the like), a complete (i.e., of both sides), or preferably selective (i.e. of one side) impregnation can be obtained. In an embodiment, the impregnation of the open mesh support according to the present process can be controlled by means of an X-ray detector which is capable of measuring the thickness of the binder during impregnation. Due to the superficiality of the impregnation, the resulting material maintains optimum elasticity and flexibility, along with a high mechanical resistance and abrading material capacity.

The binder is used in the present process substantially to bind the abrasive granules to the teaseled mesh. Said binder is applied to the open mesh support in a substantially liquid form (step a.), to be then converted into a solid form (step c.) for example by means of thermal crystallisation, such as detailed below. In other words, the binder, upon application to the mesh, has such a viscosity as to be capable of being superficially absorbed by capillarity from the threads composing the mesh surface, for example ranging between 1000 mPas and 10000 mPas, as measured at 25° C.

Preferably, the binder is a heat-melting derivative, therefore step a. is carried out at a temperature higher than 70° C. and the drying step is carried out as a cold process, i.e. at a temperature ranging between 10° C. and 70° C., preferably between 10° C. and 50° C.

In an equally preferred embodiment, the binder is a thermosetting derivative, therefore step a. is carried out at a temperature from 20° C. to 70° C. and the drying step is carried out as a hot process, i.e. at a temperature of at least 80° C.

Preferred termo-melting glues are selected among: PUR-type polyurethane glues, Ethyl Vinyl Acetate, Polyolephines, whereas the preferred thermosetting glues are selected from: phenolic, furan, epoxy and acrylic resins.

For example, when a PUR-type reactive polyurethane binder is used, the impregnation in step a. is carried out as a hot process at a temperature of about 140° C., while the drying step c. is carried out as a cold process, i.e. at a temperature below 70° C., preferably between 10° C. and 50° C.

In any case, the binder used for the impregnation of the open mesh support allows maintaining the flexibility of the support and the conformability thereof to the surfaces to be worked, thereby ensuring the elasticity of the support without at the same time causing the grain to lose adherence to the surface. The amount of binder being used can depend on the size of the threads and/or grain size of the abrasive used and can preferably range between 10 g/m$^2$ and 350 g/m$^2$.

The application of the abrasive grains according to step b. is preferably carried out on the non-teaseled side of the mesh, on threads that have absorbed the binder by capillarity and are superficially impregnated therewith. The abrasive granules used in the invention can consist of, for example, aluminium oxide, silicon carbide, zirconium, ceramic, synthetic diamond or a combination thereof. The sizes of the abrasive granules can range from P16 to P3000 according to the scale FEPA. Advantageously, the abrasive grains can be scattered directly and in an even and ordered manner on the impregnated thread not yet dried, such as by gravitational fall or electrostatic application, or by means of spraying, or in any manner allowing the abrasive granule to be directly applied to the glued surface, without using further glues or abrasive agglomerates.

At the end of the application of the granules, the material is subjected to drying according to the second step c., such as to solidify the binder and allow the final structure to be consolidated.

To this purpose, the step c. can occur through thermal treatment either by heating or cooling, depending on the type of binder being used and the thermoplastic properties thereof, such as detailed above.

The drying or consolidation of the binder can be carried out through any means allowing the binder to dry or harden (or crystallise), generally through irradiation or convection, for example in an oven or using UV, IR lamps, or through cooling.

At the end of step c., the abrasive granules are stably bound to the surface of the mesh and allow obtaining the final abrasive material.

In an embodiment, the present process comprises, at the end or also before the drying step c., a further impregnation and drying step d., using a binder that can be either the same that was used in step a., or a different one. The optional impregnation and drying step d. can be useful especially when the abrasive granules have large sizes, such as between P16 and P120.

Due to the present process, unlike in the prior art, the formation of agglomerates of abrasive granules and binder on the fibre (as illustrated, for example, in FIG. 1) can be avoided, thereby obtaining a continuous structure characterized by threads impregnated with binder by capillarity, coated by the abrasive granules (such as in FIG. 2). Thereby, not only an even distribution of the granules on the open mesh fibre can be obtained, but it is also possible to obtain a high flexibility of the final abrasive woven material, associated with an optimum resistance and an improved abrasive power, such as illustrated in the experimental section attached herein.

In a further aspect, the present invention relates to an open mesh abrasive, material that is obtained (or can be obtained) by means of the above process, which has a structure illustrated for example in FIG. 2.

The present abrasive material can be either made in form of discs or belts, or shaped according to the requirements or the machine used to apply it. Advantageously, the abrasive material of the invention has the following characteristics:

- it is extremely flexible and conformable to the work surfaces. This is due to the inherent properties of the teaseled support elastic mesh which are not substantially changed by the process of the invention. Furthermore, this flexibility and conformability can be enhanced by means of coupling with other supports, such as described below;
- it has a high surface finish. The homogeneity and conformability of the support abrasive surface allows the pressure of the individual abrasive to be evenly distributed, thereby providing a very high superficial finish as compared with a traditional abrasive, with the grain being the same. Furthermore, this behaviour is not hindered by glues or fixing resins. Thereby, the granules will work simultaneously;
- it has a very low tendency to clogging. The teaseled support mesh has an open structure, which allows air and dusts, as well as work residues, to easily pass therethrough.

In a further embodiment of the invention, the present abrasive material can be coupled to an additional support, which may either be permeable to dust and work residues, or not. For example, the abrasive mesh can be coupled, preferably by contact, to the non-impregnated surface, to a sponge, a paper, a cloth, a woven fabric or a plastic film preferably provided with holes, or other supports that can be conventionally used in the manufacture of flexible abrasives. This allows providing the abrasive material of the invention with further physical-mechanical properties. For example, greater tensile strength can be provided by means of coupling with a paper support, or greater compressibility can be obtained by means of coupling with a sponge.

By way of non-limiting example, the abrasive material of the invention in the form of open mesh having a teaseled surface can be laminated to a woven fabric (such as Velcro®), such as to have a product that is cost-effective and easily workable (disc die-cutting). It can also be coupled to a velcro sponge fabric (sponge on the one side, Velcro® on the other side) on the sponge side, such that the resulting finished product can have high compressibility and conformability.

In any case, the resulting abrasive material, either laminated or coupled, will be permeable to air and work residues, further ensuring an optimum work surface.

In a preferred embodiment, the abrasive material is coupled with a paper or cloth support, or a combination thereof. This product is particularly convenient for the preparation of jointed abrasive belts. The use of a teaseled abrasive mesh, in fact, is hardly applicable to automatic, manual or semi-automatic polishing machines. This impossibility is mainly due to the low tension strength of the teaseled mesh and the inherent compliance of the support.

The coupling with a second support such as paper or cloth, for example conventionally used as a support in the traditional abrasives, on the other hand, allows using the present abrasive material also in the form of abrasive belt. Preferably, the present material is coupled with the second support by means of contact with the non-impregnated side, the latter being teaseled. In fact, the presence of a teaseled surface (as the interface between the present material and the additional support) allows obtaining a useful dampening to have vertical compressibility of the granules and have better stability and finish final properties.

In a further aspect, the invention relates to the use of the above abrasive material, optionally coupled, for the polishing of surfaces. Said surfaces can be made of metal, plastic, wood or The like, be rough or treated with paints or coatings. In a preferred embodiment, the open mesh abrasive material herein is used for the polishing of surfaces for the removal of paint.

The present invention will be now described in the following experimental section, without limiting the scope thereof.

EXPERIMENTAL SECTION

Example 1

Preparation of an Abrasive Material According to the Present Invention, Designated as ABRASILK (FIG. 2)

A polyurethane heat-melting glue is applied as a binder to a nylon teaseled mesh weighing 90 g/m$^2$ by means of a melt head. The application of the glue is point-like. The aluminium oxide abrasive is applied by gravitational fall on the adhesived surface.

The grain size of the abrasive is selected to have a mark on the surface, 20 μm, 13 μm and 9 μm, respectively. The drying of the abraded support is completed at room temperature. The product thus obtained is cut in form of 150 mm-diameter discs. The discs are tested by means of a random orbital sander Rupes Scorpios—Orbita 3 mm.

The compared product is Sun L312T —plastic film support, in P800, P1500 and P2000 grain, market top level. The reference surface is a 1 mm metal sheet, on which primer, paint and clearcoat are applied. In the test, removal speed and surface finish are evaluated in relation with a traditional abrasive with the same finishing.

TABLE 1 properties of the inventive abrasive material as compared to a known abrasive material, having closed surface and obtained by means of application of a binder/granule agglomerate.

| | | | | | | Average |
|---|---|---|---|---|---|---|
| SUN P800-Appearance of clogging at 25 seconds | | | | | | |
| RA | 0.31 | 0.4 | 0.32 | 0.33 | 0.32 | 0.34 |
| RZ | 2.2 | 2.7 | 2.3 | 2.1 | 1.9 | 2.24 |
| ABRASILK 20 um-Disc finished at 3 minutes and 20 seconds | | | | | | |
| RA | 0.3 | 0.31 | 0.37 | 0.31 | 0.29 | 0.32 |
| RZ | 2 | 2.2 | 2.3 | 2.3 | 2.1 | 2.18 |
| SUN P1500 Appearance of clogging at 40 seconds | | | | | | |
| RA | 0.15 | 0.17 | 0.17 | 0.13 | 0.13 | 0.15 |
| RZ | 1.2 | 1.2 | 1.3 | 1.2 | 1 | 1.18 |
| ABRASILK 13 um-Disc finished at 3 minutes 30 seconds | | | | | | |
| RA | 0.15 | 0.15 | 0.15 | 0.13 | 0.18 | 0.15 |
| RZ | 1 | 1.5 | 1.1 | 1 | 1.4 | 1.20 |
| SUN P2000 Appearance of clogging at 35 seconds | | | | | | |
| RA | 0.09 | 0.09 | 0.08 | 0.09 | 0.07 | 0.08 |
| RZ | 0.7 | 0.6 | 0.7 | 0.6 | 0.5 | 0.62 |
| ABRASILK 9 um-Disc finished at 1 minute and 30 seconds | | | | | | |
| RA | 0.09 | 0.07 | 0.09 | 0.08 | 0.08 | 0.08 |
| RZ | 0.7 | 0.6 | 0.8 | 0.6 | 0.5 | 0.64 |

RA designates average roughness.
RZ designates the height of the irregularities in 10 points.

The tests further demonstrate that, with the same surface finish, the operating life of the product object of the invention is at least 3 times higher than a traditional, market top level product (35 seconds of the market top level products as compared with 1 minute and 35 seconds of the inventive product).

The above data finally demonstrate that the conventional products become unusable because of the appearance of clogging (accumulation of work residual dusts on the abrasive surface), whereas the present material loses its efficacy only when the abrasive granule is worn out and no longer cutting.

The invention claimed is:

1. A process for the preparation of an open mesh abrasive material, comprising the following steps:

a) impregnating only a second side of an open mesh support with a binder;

b) applying abrasive granules on said second side; and c) drying the material obtained resulting in the open mesh abrasive material;

wherein a first side of the open mesh support is not-impregnated and is a teaseled side and wherein the second side of the open mesh support is the impregnated side and is a non-teaseled side.

2. The process of claim 1, wherein the drying comprises a hardening thermal treatment.

3. The process of claim 1, wherein the impregnating is of a selective horizontal type, parallel to the surface of the mesh to be impregnated and limited to the surface of the mesh.

4. The process of claim 1, wherein the binder of step a) is a heat-melting compound selected from the group consisting of PUR polyurethanes, Ethyl Vinyl Acetate and Polyolefines.

5. The process of claim 1, wherein the binder of step a) is a thermosetting compound selected from the group consisting of phenolic, furan, epoxy and acrylic resins.

6. The process of claim 1, wherein the abrasive granules are selected from the group consisting of aluminum oxide, silicon carbide, zirconium, ceramic, synthetic diamond, and a combination thereof.

7. The process of claim 1, wherein the applying of the abrasive granules is carried out using a technique selected from the group consisting of gravitational fall, electrostatic application, and spraying.

8. The process of claim 1, wherein the drying is carried out using irradiation or convection.

9. The process of claim 1, further comprising a step d) of applying a further binder and drying.

10. An item of open mesh abrasive material prepared by a process comprising the steps of:

impregnating only a second side of an open mesh support with a binder, applying abrasive granules on said second side, and drying the material obtained resulting in the open mesh abrasive material, whereby a first side of the open mesh support is not-impregnated and is a teaseled side and wherein the second side of the open mesh support is the impregnated side and is a non-teaseled side.

11. The item of claim 10, coupled to a further support material permeable to dust.

12. The item of claim 11, wherein said further support material is selected from the group consisting of a sponge, a paper, a cloth, a woven fabric, and a plastic film, and which are provided with holes or have an open structure.

13. A process for the preparation of an open mesh abrasive material, comprising the following steps:

a) impregnating at least one of a first side and a second side of an open mesh support with a binder;

b) applying abrasive granules on said at least one impregnated side;

c) drying the material obtained resulting in the open mesh abrasive material; and d) of applying a further binder and drying wherein the first side of the open mesh support is a teaseled side and wherein the second side of the open mesh support is a non-teaseled side.

* * * * *